United States Patent [19]

Sheehan

[11] 4,142,620

[45] Mar. 6, 1979

[54] ACCESS CONTROL SYSTEM

[75] Inventor: Edward P. Sheehan, Canton, Mass.

[73] Assignee: Massachusetts Bay Transportation Authority, Boston, Mass.

[21] Appl. No.: 840,843

[22] Filed: Oct. 11, 1977

[51] Int. Cl.[2] ..... G07F 17/14

[52] U.S. Cl. ..... 194/78; 49/47

[58] Field of Search ..... 194/4 C, 4 E, DIG. 24, 194/78; 49/13, 43, 47, 49

[56] References Cited

U.S. PATENT DOCUMENTS

| | | | |
|---|---|---|---|
| 2,714,264 | 8/1955 | Odell | 49/47 X |
| 3,559,341 | 2/1971 | Alvarado | 49/47 |

*Primary Examiner*—Stanley H. Tollberg
*Attorney, Agent, or Firm*—Fred Jacob

[57] ABSTRACT

An access control system is disclosed wherein a passageway normally blocked by a gating structure such as a turnstile is opened to admit a person upon insertion of a coin into a coin slot, or upon insertion of an encoded card into a read head.

25 Claims, 13 Drawing Figures

ACCESS CONTROL SYSTEM

The present invention relates in general to new and improved access control systems and in particular to a system wherein persons are individually admitted through a passage either by placing a coin into a slot provided, or by unlocking normally blocked gating means upon presentation of appropriate identification indicia to a recognition device.

BACKGROUND OF THE INVENTION

Access control systems wherein a passageway normally blocked by gating means, such as a turnstile, is opened upon the insertion of a coin or token into a slot provided for that purpose are well known in the art. In some of the most commonly used systems of this type, the coin or token becomes part of a linkage, whereby the force applied against the blocking turnstile arm by the person seeking to enter the passageway is utilized to unlock the turnstile. Such systems are subject to extremely heavy use, particularly during peak traffic periods. Accordingly, the reliability of such systems and their trouble-free operation for extended periods is a primary concern. Further, since such systems must often operate unattended, they must be capable of withstanding abuse and vandalism with minimum downtime.

As a consequence of the conditions under which they must operate, turnstile systems, particularly those installed in areas of heavy use, have been built as massive devices wherein the use of delicate parts and sensitive adjustments is avoided. As a rule, such a system represents a relatively large capital investment on the part of the private or public operator of the system, e.g. on the part of a transit authority, which is expected to remain in service for an extended period.

The advent of identification recognition systems capable of responding to cards that carry encoded identification indicia, such as magnetic stripes or self-nucleating wires, has added a degree of flexibility not previously available. For example, such cards can be readily adapted to a flexible fare structure, e.g. one that distinguishes between different classes of commuters. Further, by suitably adapting the logic circuitry which receives the signal generated by the card reader, such cards may be encoded to limit their use to certain time periods, e.g. to a particular week or month, or to certain hours of a day. Such cards may also be prepared to provide the user with a specified number of admissions so that, upon the occurrence of each recognition, a cancellation takes place. Following the last one of a predetermined number of cancellations, the card is rejected by the recognition system and no longer unlocks the turnstile.

The adoption of this new technology presents many difficulties with respect to present day access control systems. In many cases, the large investment in existing, operating turnstile systems precludes the substitution of totally new systems. Further, the introduction of the new technology does not as a rule obviate the use of coin-operated turnstile systems, at least for the present. Accordingly, it has been found desirable to retrofit existing turnstile systems in a manner where they are able to accept the newly introduced cards, as well as coins or tokens heretofore in use.

A number of technical problems arise when retrofitting is attempted. In general, a coin successfully passed through the coin receiver, or a card successfully read by the card reader, unlocks the turnstile locking mechanism and permits one individual to pass. In those turnstile systems which are most commonly in use today, wherein the coin temporarily becomes part of the linkage mechanism which acts to unlock the turnstile, the introduction of card readers requires a substitute link which takes the place of the coin. Rather than dropping out of the linkage, as is the case with a coin after the turnstile is unlocked, the substitute link must be retracted from its operative position and held in readiness for subsequent use.

Past attempts at retrofitting such turnstile systems have been largely unsuccessful due to their poor operating reliability. The retrofit construction often results in a condition wherein, due to the relatively large forces involved, the substitute link becomes trapped in its operating position and continues to maintain the turnstile in an unlocked condition after the person has passed through the normally blocked passage.

Repeated failures at devising a reliable retrofit system using the existing mechanism have led to the development of systems wherein the card-operated mechanism of the turnstile is implemented separate and apart from the coin-operated structure. Such turnstile systems have proved to be expensive to build and to maintain owing to the fact that much of the existing structure has to be functionally duplicated. Moreover, the added structure must be accommodated in the limited space available within the turnstile housing, thereby increasing the cost of design, installation and servicing of the turnstile.

OBJECTS OF THE INVENTION

It is a primary object of the present invention to provide an access control system which avoids the foregoing disadvantages.

It is another object of the present invention to provide a reliable turnstile system at moderate cost, which is capable of admitting persons upon either the insertion of a coin in a slot, or upon passing an encoded card through a card reader.

It is a further object of the present invention to provide apparatus for retrofitting existing coin-operated turnstile systems to provide the added capability of reliably carrying out card-operated admissions.

These and other objects of the present invention together with the features and advantages thereof will become apparent from the following detailed specification, when considered in conjunction with the accompanying drawings in which like numerals identify corresponding parts.

BRIEF DESCRIPTION OF THE DRAWINGS

FIG. 3B illustrates the lever mechanism in its start position for coin operation, corresponding to the condition shown in FIG. 3A;

DESCRIPTION OF THE INVENTION

Figure 1:
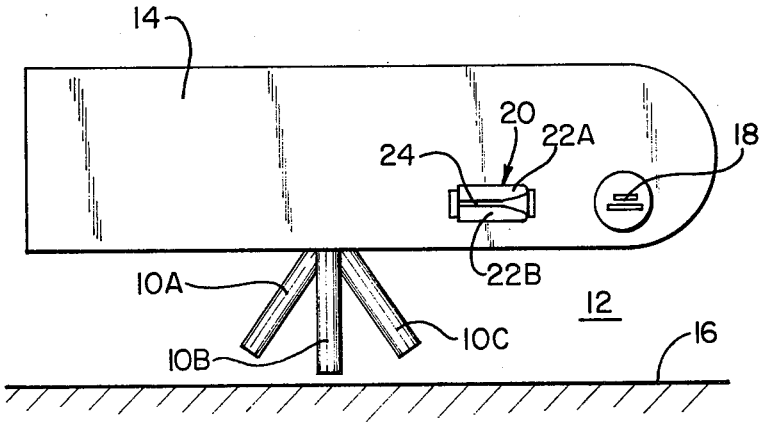
FIG. 1 is a plan view of an exemplary turnstile which may be used with the present invention.

With reference now to the drawings, FIG. 1 illustrates in plan view a turnstile of the type in which the present invention may find employment. A set of turnstile arms 10A, 10B and 10C is arranged in the usual angular relationship of the arms, whereby one of them, (arm 10B in FIG. 1), normally blocks a passageway 12. The latter is defined by the turnstile housing 14 and a fixed wall 16, e.g. the vertical wall of an adjacent turnstile. A coin receiving slot 18 extends through the upper surface of housing 14. The latter further carries an externally mounted card reader head 20 positioned immediately following slot 18. For the sake of illustration, the relative size of units 18 and 20 has been exaggerated. The card reader head comprises a pair of rounded surfaces 22A and 22B arranged to define a slot 24 therebetween. As shown, slot 24 widens toward its right hand end to assist in the insertion of a card.

Figure 2:
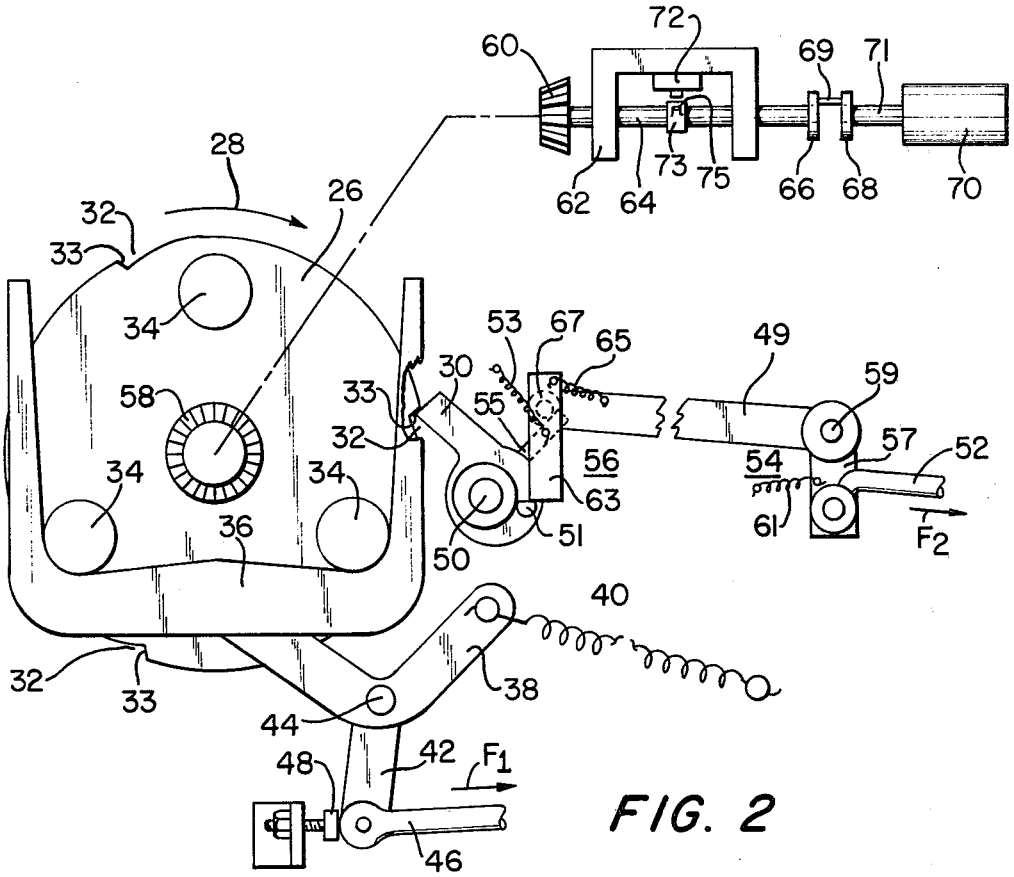
FIG. 2 illustrates the turnstile locking mechanism and its associated components.

FIG. 2 illustrates the turnstile locking mechanism which includes a ratchet plate 26 geared in known manner to turnstile arms 10, so as to rotate 120° with each rotation of the latter when permitted to do so by pawl 30. Rotation of the ratchet plate takes place in the direction of arrow 28 as a result of the rotation imparted to the turnstile by a person walking through passage 12. Ratchet plate 26 includes three recesses 32, positioned 120° apart, each having an impact surface 33. Pawl 30 is adapted to engage each recess 32 and to bear against surface 33 thereof to lock the ratchet plate, and hence the turnstile, against rotation. Ratchet plate 26 further includes three compression roller studs 34. Two of the studs are at all times in contact with a compression shoe 36, which is supported separately from plate 26 and is positioned above the latter.

An L-shaped link 38 is positioned to pivot about a fixed post 44. A link 42 is pinned to link 38 so as to rotate therewith. Link 38 pivotably attaches to compression shoe 36 and it is biased to the position shown in FIG. 2 by a spring 40. A coin lever connecting rod 46 is pivotably attached to the other end of link 42 and it is biased into contact with a position stop 48 by the action of spring 40.

Pawl 30 widens at its lower end and it is rotatably disposed about a pivot 50 which carries a flattened pin 51. A spring 53 pulls against a tab 55 of the pawl 50 so as to maintain the pawl in the position shown. When the pawl is turned in a clockwise direction it disengages from recess 32 and unlocks ratchet plate 26.

Pawl 30 is coupled to a release lever connecting rod 52 by way of an elongated member 49 and a pair of linkages which are generally designated by the reference numerals 54 and 56. Linkage 54 comprises a link element 57 which rotates about a fixed pivot 59 and which is biased in a clockwise direction by spring 61. Linkage 56 comprises a link element 63 which is pivotably attached to member 49 and which is biased in a clockwise direction by a spring 65. Upon the application of a force $F_2$ to rod 52 in the direction shown, element 57 pivots in a counterclockwise direction about pivot 59 and causes member 49 to do likewise. Nut 67 bears against tab 55 and thus turns pawl 30 in a clockwise direction so as to release it from ratchet plate 26 and free the latter for rotation.

Ratchet plate 26 further includes a bevel gear 58 which is adapted to engage a pinion gear 60. For the sake of illustration, gear 60 and the mechanism driven by it, are shown separately in FIG. 2. Gear 60 is fastened to a shaft 64 which is rotatably held by a bracket 62, which itself is mounted to a fixed surface. Shaft 64 extends through bracket 62 and terminates in a drive wheel 66 which is fastened to the shaft. A coupling link 69 couples drive wheel 66 to a crank wheel 68 for rotation in one direction only. A shaft 71 connects crank wheel 68 to counter 70. The count of the latter is incremented by 1 each time pinion gear 60 turns 360°, corresponding to a 120° rotation of ratchet plate 26. Shaft 64 carries an adjustable collar 73 which includes a cam 75. A normally closed microswitch 72 is opened each time it is contacted by cam 75 during one complete revolution of shaft 64. Since one shaft revolution corresponds to a 120° turn of ratchet plate 26, microswitch 72 is opened whenever the turnstile is turned to admit a person through passage 12.

As shown in FIG. 3B, rod 46 is coupled to a coin lever 74 by means of a pivot 75. Lever 74 is adapted to rotate about a pivot 76, in a plane parallel to the plane of the drawing. A coin lever extension bar 78 is mounted on lever 74 by means of a seating pin 88 and a bolt 82 which extends slidably through lever 82 and threads into extension bar 78. One end of bolt 82 terminates in a bolt head 84 which abuts extension bar 78. A compression spring 80 encircles bolt 82 and is confined between lever 74 and a nut 86 which is threaded onto the opposite end of bolt 82. The pressure exerted by the spring draws bolt head 84 into contact with extension bar 78 and thus holds the latter against lever 74. Thus, the spring-loaded bolt arrangement serves as a shock absorber with respect to jamming of coin slot 18, which would block the motion of extension bar 78 to the right in the drawing. If force applied to rod 46 moves lever 74 to the right while the coin slot is jammed, extension bar 78 separates from lever 74 against the force of spring 80 so as to avoid damage to the mechanism.

An assembly 90 comprises an L-shaped bracket 92 mounted on coin lever 74. The assembly further includes a coin release bolt 94 and a latch release bolt 98 mounted on the bracket, both extending in a direction substantially normal to lever 74. Both bolts preferably consist of stainless steel and include hardened, rounded ends 94A and 98A respectively, which face a release lever 102. Both bolts are mounted on bracket 92 in a manner which permits the bolt length to be adjusted. Bolt 94 engages a bore of the bracket in which it is fixed by means of a set screw 96 which threadedly engages the bracket at right angles to bolt 94. Bolt 98 engages a threaded bore of bracket 92 and includes a nut 99 integral with the bolt which assists in positioning the bolt in the bore. A nut 100 is tightened against bracket 92 to fix bolt 98 in position.

Release lever connecting rod 52 is coupled to release lever 102 by means of a pivot 104 shown in dotted outline because it is located on the undersurface of lever 102. Lever 102 is adapted to rotate about a pivot 106, in a plane parallel to the plane of the drawing. In a preferred embodiment of the invention, levers 74 and 102 have a common plane of rotation. A pair of springs 77 and 79, fixed to a stud 81, urge levers 74 and 106 respectively in a clockwise direction. Thus, the force applied to rod 46 by lever 74 reinforces the action of spring 40 (FIG. 2), in biasing rod 46 against position stop 48.

The action of spring 79 biases release lever extension bar 78 into abutment with a bracket 112 which is mounted on a coin receiver 114. A positioning screw 116 threads into bracket 112 and is adapted to extend beyond the right hand edge of the latter if it is desirable to move the start position of lever 102 further to the right. A nut 115 is provided to fasten screw 116 in position.

Figure 3A:
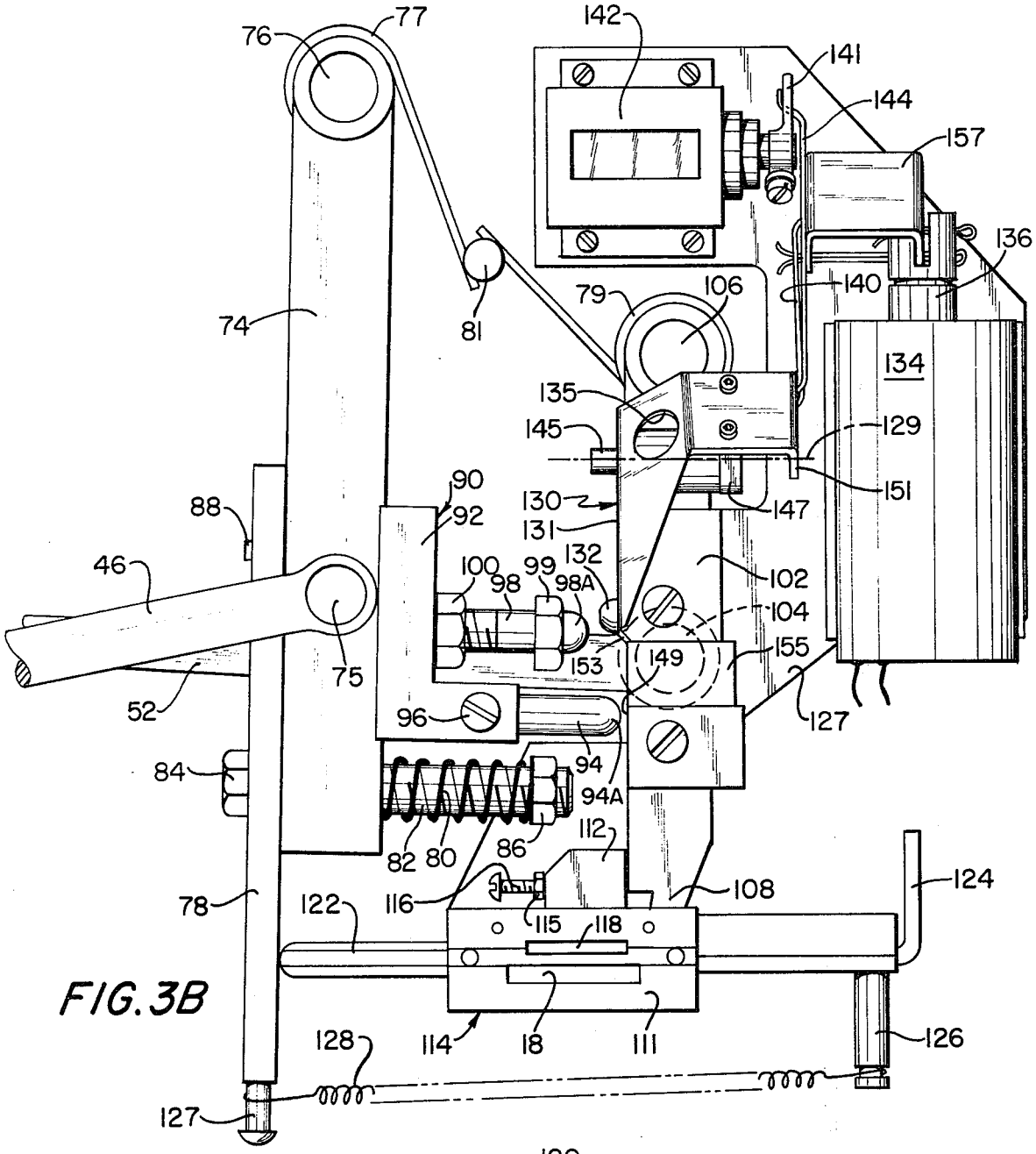
FIG. 3A illustrates the coin receiver in its initial phase of operation.
Figure 3A:
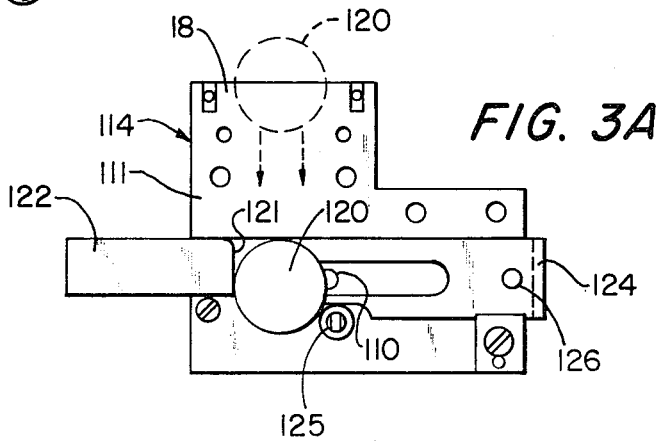

Coin receiver 114 includes the aforementioned coin slot 18 and a second slot 118 which may accept a token in lieu of a coin. A coin 120 is illustrated in FIG. 3A, shown in dotted outline upon entry, and in solid lines in the initial position in which it comes to rest upon insertion. In the latter position, the periphery of coin 120 is held at three points, i.e., shoulder 121 of a coin slide 122, by a roller 125 and by coin-contacting end 110 of release lever extension bar 108. The latter is shown in greater detail in FIGS. 8 and 9.

Coin slide 122 slidably engages the stationary housing 111 of coin receiver 114 and terminates in a tab 124. The latter is positioned substantially at right angles to the coin slide proper and serves as a stop against leftward movement of the latter beyond a predetermined point. A pin 126 is mounted on coin slide 122, in the vicinity of tab 124, so as to move with the coin slide. Pin 126, which extends in the opposite direction from tab 124, carries one end of a tension spring 128. The latter is stretched between pin 126 and a pin 127 which terminates coin lever extension bar 78. The function of spring 128 is to maintain coin slide 122 in contact with extension bar 78.

A bracket 127 is mounted to lever 102 in a manner where it rotates with the lever about pivot 106. A shaft 145 is mounted on lever 102 substantially parallel to the aforesaid common plane. A bar 147 is pivotably mounted on shaft 145 so as to rotate about shaft axis 129. See FIG. 8. A latch 130 is mounted on bar 147 and is adapted to pivot with the latter through a predetermined angle about axis 129. Latch 130 includes a contact bumper 132, preferably consisting of hardened stainless steel, which is mounted on a latch surface 131. The latter surface is adjacent and substantially parallel to a back-up surface 149 of lever 102. Thus, latch surface 131 moves in a plane substantially normal to the aforesaid common plane.

Figure 8:
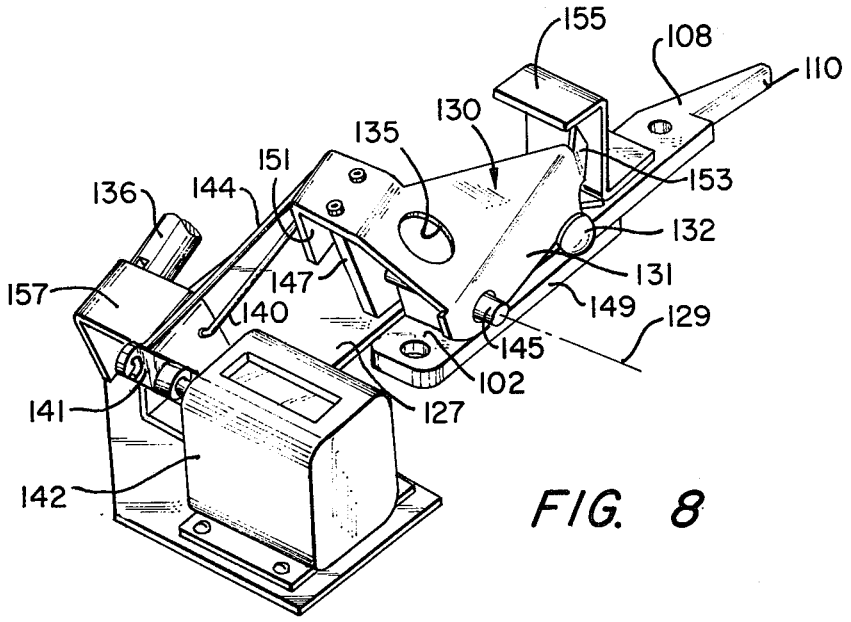
FIGS. 8 and 9 illustrate the latch mechanism in greater detail.
Figure 9:
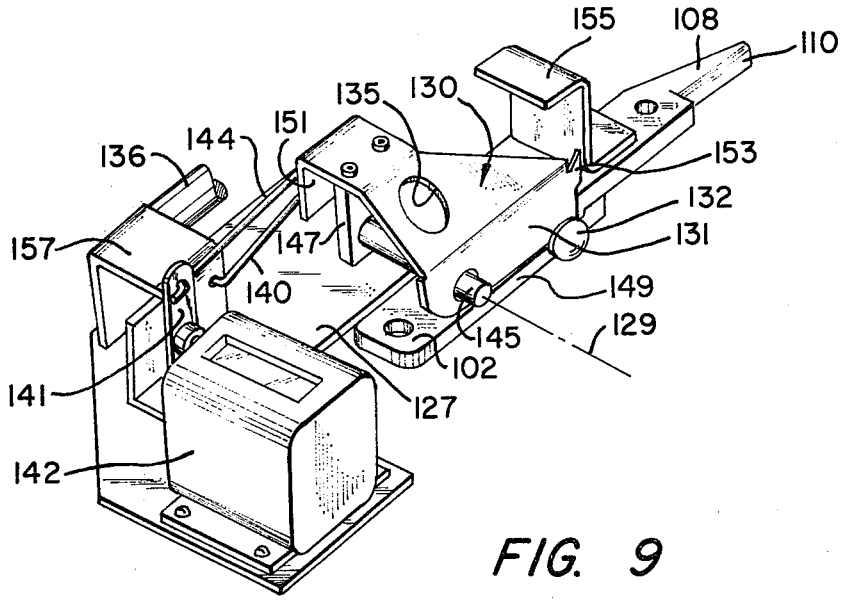

An L-shaped latch extension 151 is connected to a crank 141 of a counter 142 by means of a stiff wire link 144. Counter 142 is mounted on bracket 127. In a preferred embodiment of the invention, crank 141 is normally biased to the position shown in FIG. 8 by a spring which has been omitted from the drawing for the sake of clarity. The pull exerted by wire link 144 thus pivots latch 130 to its retracted position, as shown in FIG. 8.

Latch 130 includes a tab extension 153 which contacts the underside of a latch stop 155 mounted on extension bar 108, to determine the limit of the retracted latch position. A second wire link 140 connects latch extension 151 to a U-bracket 157, which is pivotably mounted with respect to bracket 127 so as to move with latch 130. A solenoid 134 is mounted on bracket 127 and includes a retractable core 136 which is yoked to a U-bracket 157. Thus, the spring bias of crank 191 normally pulls core 136 to an extended position, as shown in FIG. 3B.

The operation will first be explained with respect to a coin-operated unlocking operation of the turnstile. As used herein, the term "coin" is synonymous with token and it will be understood that a token may be used to perform a coin-operated function. Upon insertion of coin 120 into slot 18 (or slot 118), the coin drops to the position shown in solid outline in FIG. 3A and is supported there at three points, essentially as described above. At this time, levers 74 and 102 are in their start position, as shown in FIG. 3B.

Having inserted a coin into slot 18, the person in passageway 12 applies pressure against turnstile arm 10B (FIG. 1). The force so exerted is transmitted to locked ratchet plate 26, (FIG. 2), and turns the latter through a small angle against pawl 30. The degree of motion permitted is relatively small and is due primarily to slack in the system. Thus, the compression roller studs 34 in contact with compression shoe 36 cause the latter to move slightly against the force exerted by spring 40. The latter movement rotates link 38, and hence link 42, in a counterclockwise direction about pivot 44. This motion is transmitted to coin lever connecting rod 46 and thus a force $F_1$ is applied to rod 46 in the direction shown in FIG. 2. The applied force causes coin lever 74 to begin its pivotal motion in a counterclockwise direction from the start position illustrated in FIG. 3A.

Figure 4B:
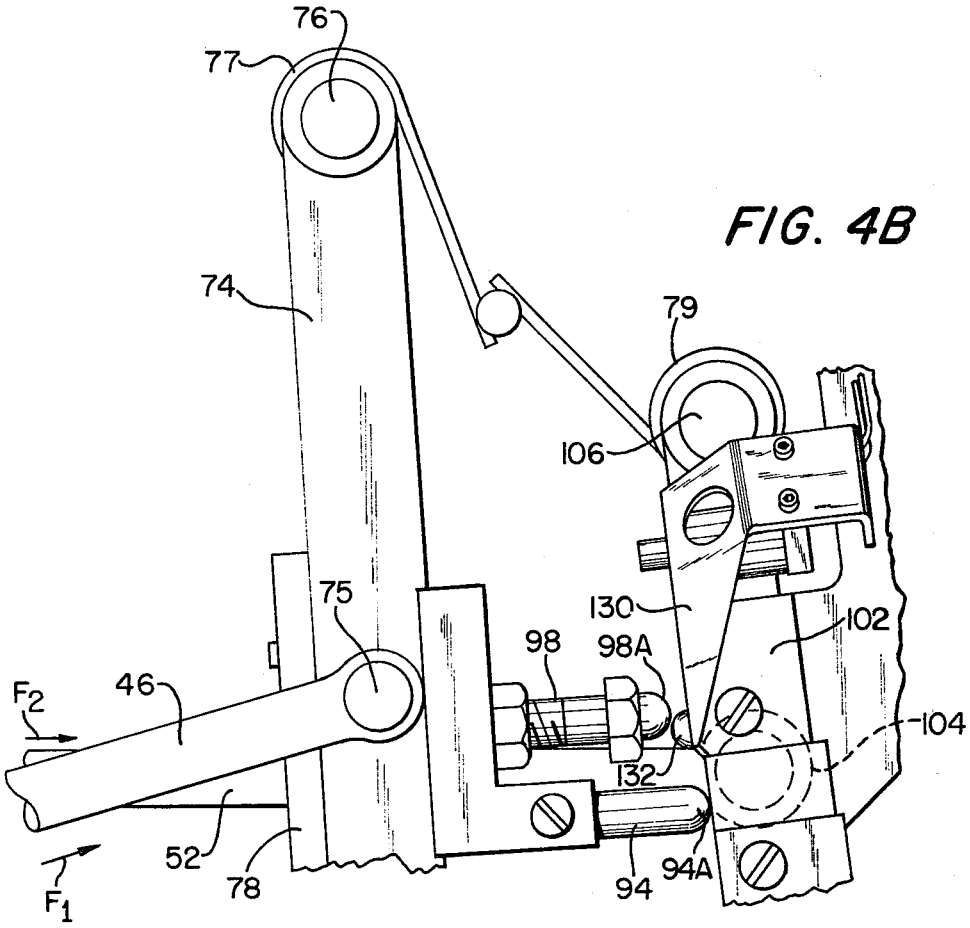
FIG. 4B illustrates a portion of the apparatus of FIG. 3B in an intermediate position, corresponding to the condition shown in FIG. 4A.
Figure 4A:
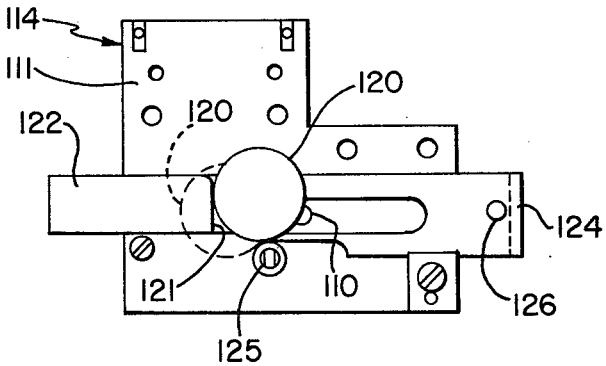
FIG. 4A illustrates the apparatus of FIG. 3A in an intermediate phase of operation.

FIGS. 4A and 4B illustrate the operation at an intermediate stage. When lever 74, and hence extension bar 78, pivot in a counterclockwise direction upon the application of force $F_1$ by rod 46, the force applied to coin slide 122 causes the latter to move to the right with respect to stationary housing 111. Thus, coin 120 is moved from its previous position, shown in broken lines, up onto roller 125. See FIG. 4A. The motion of the coin pushes end 110 of extension bar 108 to the right and thereby rotates release lever 102 in a counterclockwise direction. Thus, the coin acts as a link between the two levers and transmits the force applied by lever 74 to lever 102.

The pivotal motion of lever 102 in a counterclockwise direction exerts a pull $F_2$ on release lever connecting rod 52 in the direction shown in FIG. 4B. The force so applied to rod 52 is transmitted by way of linkages 54 and 56 and rotates pawl tab 55 in a clockwise direction. As a consequence, pawl 30 is withdrawn from the locked position in recess 32 shown in FIG. 2 and ratchet plate 26 is freed for rotation.

At this point, the continued pressure exerted against turnstile arm 10B causes the turnstile to rotate and to admit the person exerting the pressure through passage 12. Ratchet plate 26 turns 120° with the motion of the turnstile arms. The resultant motion brings a different pair of compression roller studs 34 into contact with compression shoe 36 and in the process it moves the shoe downward during the turning of the ratchet plate. The motion of the compression shoe, transmitted by way of links 38 and 42, moves coin lever connecting rod 46 further to the right and thereby pivots lever 74 to its final position.

Figure 5B:
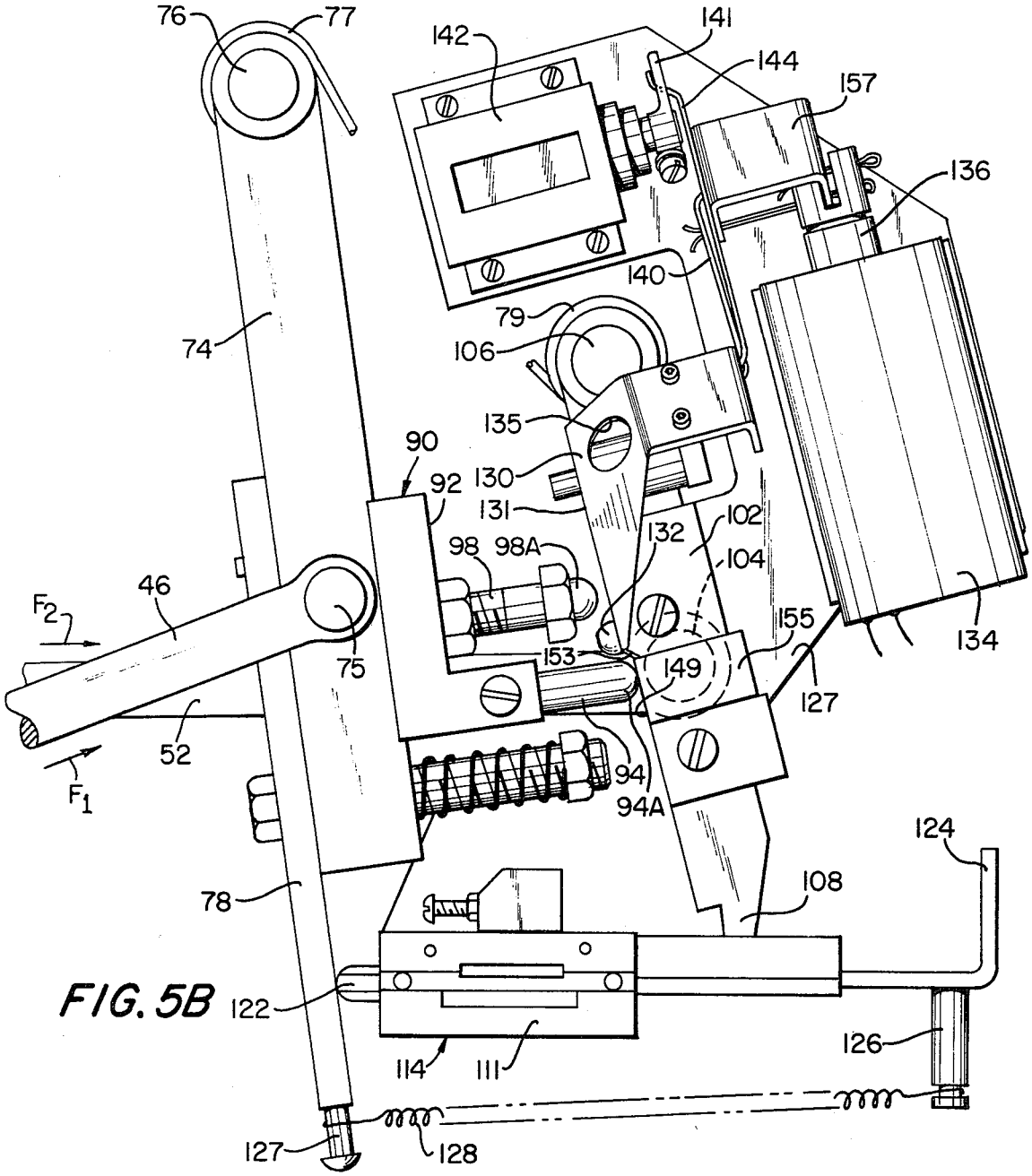
FIG. 5B illustrates the apparatus of FIG. 3B in its final position, corresponding to the condition shown in FIG. 5A.
Figure 5A:
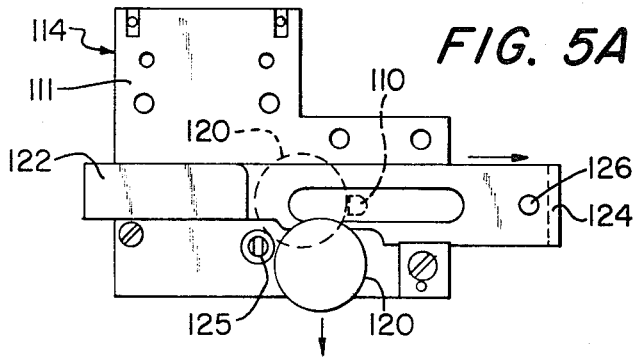
FIG. 5A illustrates the apparatus of FIG. 3A in its final phase of operation.

FIGS. 5A and 5B illustrate the coin receiver and the lever mechanism in their final positions. As shown, coin slide 122 has reached its extreme right hand position in which coin 120 has been pushed past roller 125 from the broken line position shown where it is still in contact with coin contacting end 110. As illustrated in solid lines, the coin has dropped out as a link between the levers and is shown falling to the coin collection area. The release of the coin is effected by the counterclockwise pivotal movement of lever 74 which brings end 94A of coin release bolt 94 into contact with lever 102. Thus, bolt 94 relieves the pressure on the linkage consisting of coin slide 122 and coin 120. This action establishes the mutual spacing between the two levers at a pair of points which are positioned radially inward from another pair of points at which the aforesaid linkage 122, 120 transmits force between the two levers or, more precisely, between lever extension bars 78 and 108.

The angle of pivot motion of the levers about their mutually spaced pivots 76 and 106 is chosen so that the mutual lever spacing, at selected reference points, increases with the radial distance from the pivots for increments of counterclockwise lever motion which are the same for both levers. As a consequence, as the levers reach their final position, bolt 94 relieves the pressure on the coin by which it is held in the linkage and causes the coin to be released. During the final phase of the operation, the force applied to coin lever 74 is transmitted to release lever 102 solely through coin release bolt 94.

More specifically, pivots 76 and 106 of levers 74 and 102 respectively are spaced from each other, as previously discussed. The angle through which the levers are permitted to pivot is selected such that, within this angle, the mutual spacing between selected reference points on the levers, (for example the centers of pivots 75 and 104 in FIG. 3B), increases when both levers move through equal angular increments in a counterclockwise direction. Further, the rate of increase of the aforesaid mutual spacing varies in accordance with the radial distance of the chosen reference points from pivots 76 and 106 respectively. Conversely, when the mutual spacing between a first pair of reference points is kept constant as the levers rotate jointly in a clockwise direction about their respective pivots, then the mutual spacing between a second pair of reference points, positioned radially inward from the first pair of points, will decrease.

For the purpose of explaining the operation of the present invention, it may be assumed that the mutual spacing between lever extension bars 78 and 108, which is established by coin slide 122 and coin 120, remains substantially constant in FIGS. 3A and 4A as long as the coin remains in place. During the pivotal lever movement which takes place between the start and final lever positions illustrated in FIGS. 3B and 5B respectively, ends 98A and 94A of bolts 98 and 94 respectively, both approach release lever 102. The distance of each from release lever 102 decreases until end 94A, which protrudes beyond end 98A, makes contact with the lever and thereby establishes the mutual lever spacing as explained above and as shown in FIG. 4B. During further pivotal lever motion in a counterclockwise direction bolt end 94A remains in contact with lever 102 although there is some relative displacement between them parallel to lever 102. During this pivotal lever motion the mutual lever spacing at points positioned radially outward with respect to bolt 94 increases until coin 20 is released. See FIG. 5B.

Upon completion of a 120° rotation of the ratchet plate as the turnstile is turned by the person passing through it, compression shoe 36 and link 38 are returned to their original position, (shown in FIG. 2), by the action of spring 40. As a result, coin lever connecting rod 46 is moved to the left to a position determined by adjustable stop 48. The movement of rod 46 is assisted by the action of spring 76 which urges coin lever 74 to the start position illustrated in FIG. 3B. Since the action of spring 128 maintains coin slide 122 in contact with extension bar 78, coin slide 122 now also moves to the left.

As bolt 94 moves to the left with lever 74, release lever 102 reverts to its start position under the influence of spring 79. The latter action releases the pull exerted on pawl 30 through rod 52 and linkages 54 and 56. Spring 53 rotates the pawl in a counterclockwise direction so that the pawl engages the subsequent recess 32 upon rotation of plate 26 into position. At the conclusion of the operation, the ratchet plate, and hence the turnstile arms, are again locked against rotation.

The gear ratio between bevel gear 58 and pinion gear 60 is such that shaft 64 rotates through a complete revolution for each 120° rotation of ratchet plate 26. Each shaft revolution serves to increment the count of counter 70 by one as long as the shaft rotates in the forward direction. Microswitch 72 is briefly opened during each shaft revolution at a point determined by the setting of adjustable collar 73.

Figure 10:
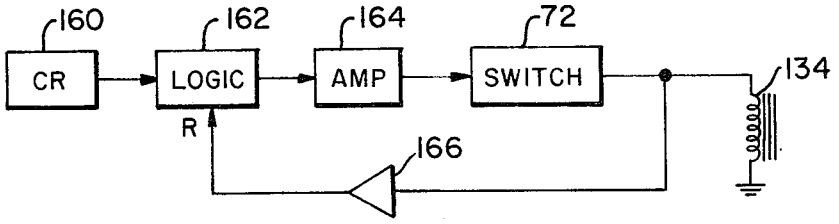
FIG. 10 illustrates a simplified exemplary circuit for operating the present invention.

FIG. 10 illustrates an exemplary circuit for activating solenoid 134 in response to the use of a card instead of a coin by the person entering the turnstile. Upon passing the card through slot 24 of card reader head 20, the card is read by card reader 160. A logic circuit 162, connected to the output of the card reader, provides a recognition signal at its own output if the card reader signal corresponds to certain predetermined criteria. The recognition signal may, for example, have a steady state signal level as long as circuit 162 is not reset. The recognition signal is applied to an amplifier 164, the output signal of which is coupled to solenoid 134 by way of series-connected microswitch 72. The aforesaid output signal is further applied, by way of an inversion stage 166, to a Reset input of logic circuit 162.

Figure 6:
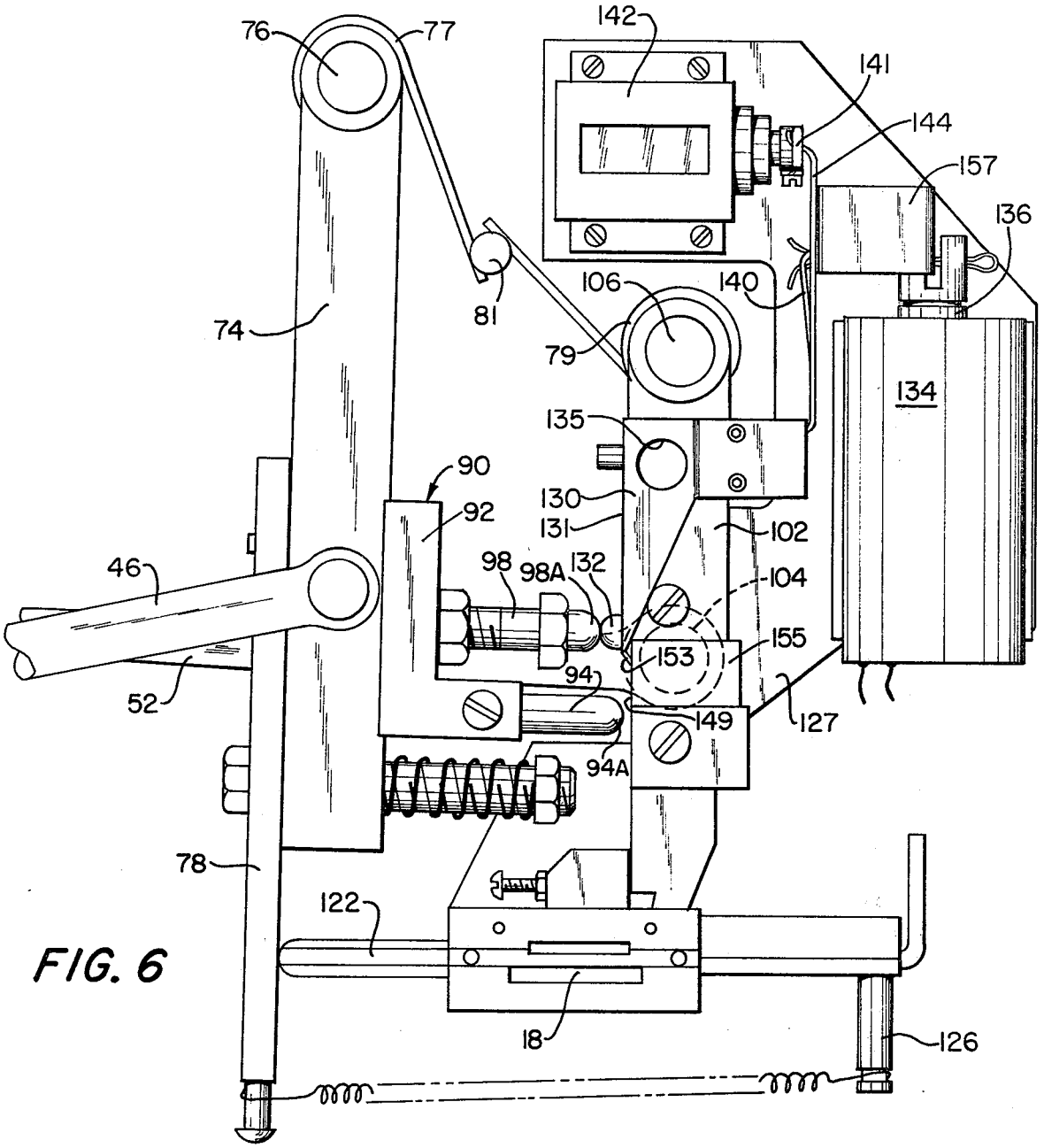
FIG. 6 illustrates the apparatus of FIG. 3B in its start position for card operation.

Provided the scan of the identification indicia contained on the card is satisfactory, as determined by logic circuit 162, an output signal is generated which energizes solenoid 134. Solenoid core 136 is pulled into the solenoid causing latch 130 to move from the retracted position illustrated in FIGS. 3B and 8, to its operative position shown in FIGS. 6 and 9. The change of position of latch 130 is apparent in plan view from a comparison of the shape of access hole 135 in FIGS. 3B and 6, respectively. Stainless steel contact bumper 132 is positioned in contacting alignment with rounded end 98A of bolt 98 when the latch is in its operative position. Thus, the transmission of force from lever 74 to lever 102 now occurs through bracket 92, bolt 98, contact bumper 132 and latch 130 which bears against backup surface 149 of lever 102 when force is applied to the contact bumper.

As before, the application of pressure against turnstile arm 10B by a person attempting to go through passage 12, results in the application of force $F_1$ to coin lever connecting rod 46. Thus, force is transmitted to coin lever 74 and causes it to pivot in a counterclockwise direction from the start position shown in FIG. 6. This force is further transmitted through the above-recited linkage, i.e. bolt 98 and contact bumper 132, to release lever 102 which is caused to rotate about pivot 106.

Figure 7:
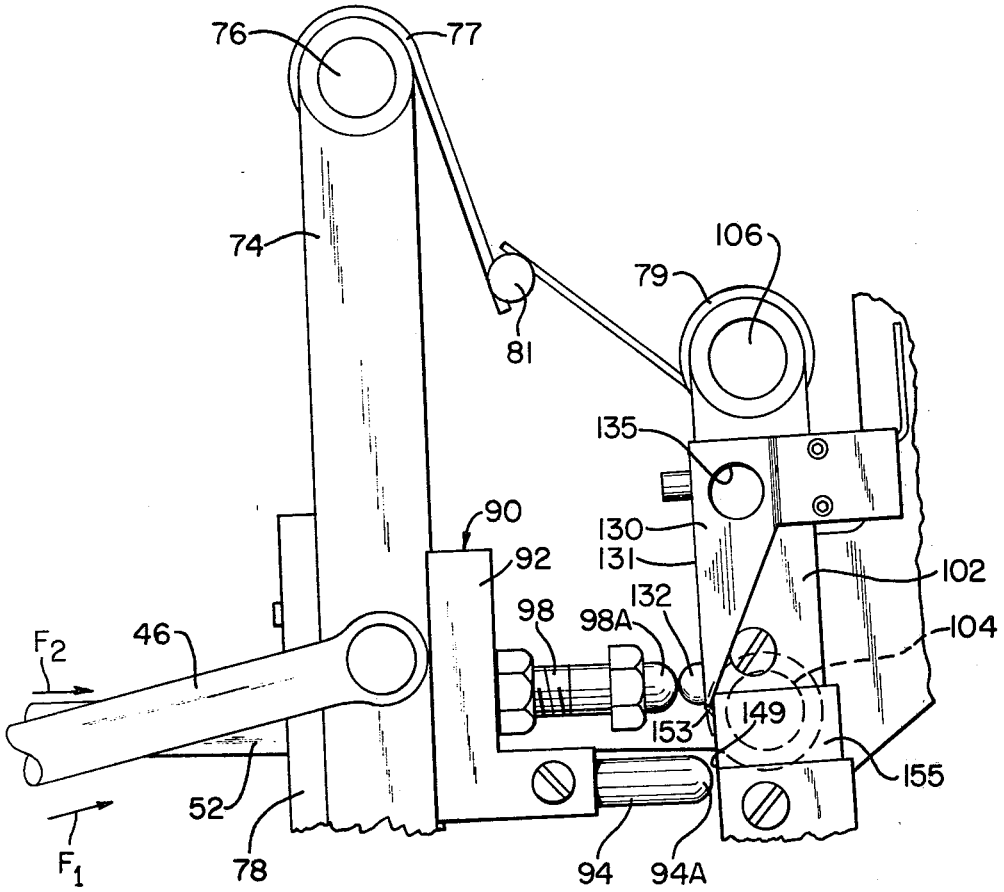
FIG. 7 illustrates a portion of the apparatus of FIG. 6 in an intermediate position.

FIG. 7 illustrates this condition at an intermediate position of levers 74 and 102. As in the case of coin operation, the action is effective to cause release lever connecting rod 52 to apply a force $F_2$ to linkages 54 and 56 and to unlock pawl 30.

The pressure applied to arm 10B by the person in passage 12 now causes the turnstile to rotate, thereby turning ratchet plate 26 by 120° and rotating shaft 64 through one revolution. The latter action increments counter 70 by one, in the manner described hereinabove. The rotation of the shaft temporarily opens microswitch 72, thereby deenergizing solenoid 134 and establishing the condition for latch 130 to return to its retracted position. The precise point in time at which solenoid 134 is deenergized is selected by the positional setting of cam 75 by means of adjustable collar 173. The absence of a signal at the output of the microswitch causes inverter 166 to apply a reset signal to logic circuit 162, resulting in resetting the recognition signal to zero and maintaining the solenoid in its deenergized state. The return of crank 141 to the position shown in FIG. 8 increments counter 142 by one, thus providing a count for card users only.

Although solenoid 134 is deenergized by the action of switch 172, the return of latch 130 to its retracted position may at first be prevented by force exerted by end 98A of latch release bolt 98 against contact bumper 132. This force may be sufficient to impede the motion of the latch, particularly when end 98A is in alignment with contact bumper 132, as is the case in the phase of the operation illustrated in FIG. 7.

It will be noted that bolt end 98A rotates about pivot 76, together with lever 74. On the other hand, contact bumper 132 rotates about pivot 106 together with lever 102 and all other components mounted on bracket 127. The different pivots of the respective contacting components cause end 98A and contact bumper 132 to become laterally displaced with respect to each other as the pivotal motion of levers 74 and 102 continues to the final lever position. Specifically, in the operational phase illustrated in FIG. 7, bolt end 98A moves in an upward direction relative to contact bumper 132. Since both parts are rounded, they slide readily past each other during such relative motion. Thus, before the final lever position is reached, latch 130 is released. Since solenoid 134 is no longer energized, the latch now returns to its retracted position, as indicated in FIGS. 5B and 8. With latch 130 out of the way, bolt 94 takes over by making contact with lever 102 and transmiting force to the latter. The operation now continues as described above for the coin operation. When the person who presented the card has passed through the turnstile, levers 74 and 102 again return to their start position.

It will be apparent to those skilled in the art that the access control system which forms the subject matter of the present invention is not limited to the specific embodiment illustrated in the drawings and described hereinabove. For example, while the identification indicia preferably takes the form of an encoded card using magnetic stripes, self-nucleating wires or the like may be used. Other recognition means may also be used to generate a recognition signal, e.g. a finger print scanner or similar device.

The invention is not limited to the function of unlocking a turnstile upon insertion of a card or coin. Other functions may be performed in addition to opening gating means, such as summoning an elevator or other vehicle once the fare is paid or the card is recognized.

Modifications of the specific mechanism disclosed may be made within the scope of the present invention. For example, the pivotable arm formed by coin lever 74 and its extension bar 78 may consist of an integral structure adapted to rotate about pivot 76. In the latter case, the action of the shock absorber comprising bolt 82 and spring 80, must be modified. Likewise, release lever 102 and its extension bar 108 may be built as an integral structure, provided only that the free end 110 is adapted to ride in contact with the coin inserted into coin receiver 114.

While it is convenient to provide a unitary assembly 90 wherein bolts 94 and 98 are both mounted on a common bracket 92, different configurations are possible. For example, the bolts may be independently mounted on coin lever 74, suitably adapted, e.g. by means of threaded holes, to receive the bolts in a manner permitting their length to be selectively adjusted. The two bolts may also be mounted on lever 102 to perform their intended function, or they may be mounted on different levers. Similarly, latch element 130 may be carried by either lever, provided it is positioned on the lever opposite to the one on which the cooperating bolt 98 is mounted. Further, contact bumper 132 and bolt 98 may be dispensed with in favor of an interposer spacer having a length dimension equal to the joint length of these two components. In the latter construction it is immaterial on which lever the latch is positioned, provided only that the interposer can be selectively positioned in the space between the levers or removed therefrom.

The interposition of contact bumper 132 by means of pivotal latch motion into alignment with end 98A of bolt 98 may also be accomplished through other types of motion. Thus, apparatus may be provided whereby the latch element is moved into and out of its operative position by linear motion. Hence, the precise configuration of the latch element will depend on the manner in which the element is used and is not intended to be limited to that shown and described. It is important, however, that the latch be backed up by an impact surface 149 of release lever 102, so that the force applied by bolt 98 against the latch element is properly transmitted to the release lever.

As explained above, one of the problems of comparable prior art systems has been the inability of the equipment to move the latch element reliably out of its operative position while force continues to be applied thereto by the contacting bolt. Where this is the case, the turnstile remains unlocked after the person has traversed the originally blocked passage. In the present invention, the problem is overcome by separating the latch release function from the function of the coin release bolt. Thus, in the present invention, bolt 94 serves a dual function: (1) When a coin is used, the bolt relieves the force on the coin and permits it to drop out of the linkage at a predetermined angular lever position; and (2) when a card is used, the bolt relieves the force on the latch element between the intermediate and final lever positions and thus permits the latch element to return to its normal retracted position. In both cases, bolt 94 serves to relieve the pressure on the interposed element and thereafter transmits the force and motion of the coin lever to the release lever.

As already noted, where latch release bolt 98 is positioned radially inward (with respect to pivot 76) from coin release bolt 94, disengagement between the rounded surfaces of bolt end 98A and contact bumper 132 occurs as these components move out of alignment with each other during the pivotal motion of levers 74 and 102 between their intermediate and final positions. In a variant embodiment of the present invention, latch release bolt 98 and contact bumper 132 may be positioned radially outward from bolt 94. In such an arrangement, once end 94A of the coin release bolt makes contact with release lever 102 to establish the mutual lever spacing, bolt end 98A and contact bumper 132 will move apart from each other as the levers pivot toward their final position. Thus, the disengagement of bolt end 98A from contact with bumper 132 is brought about by the physical separation of these components, as well as by progressive misalignment as the levers move toward their final positions.

The arrangement described above may be readily implemented by rotating assembly 90 by 180° about the axis of bolt 98, until bolt 94 is positioned radially inward of bolt 98. Such a construction may require modification of latch element 130 to avoid contact between it and bolt 94. Alternatively, the latch element may be repositioned on lever 102 so that latch pivot axis 129 is positioned radially outward with respect to bolt 98.

In the illustrated embodiment of the invention, the spring-biased crank 141 of counter 142 is employed to pivot latch element 131 to its retracted position and move solenoid core 136 to the extended position shown in FIG. 3B when solenoid 134 is not energized. It will be apparent that latch element 131 may be individually spring-biased to its retracted position. Similarly, solenoid core 136 may be independently maintained in its extended position without the action of counter crank 141.

From the foregoing discussion, it will be apparent that numerous variations, modifications, substitutions and changes will now occur to those skilled in the art, all which fall within the spirit and scope of the present invention. Accordingly, it is intended that the invention be limited only by the scope of the appended claims.

What is claimed is:

1. An access control system of the type wherein either a coin or identification indicia are used to admit a person through a normally blocked passage, said system comprising:

gating means interposed in said passage;

means for locking said gating means, said locking means permitting limited motion of said locked gating means upon the application of force thereto, first and second arms disposed to pivot substantially in a common plane about a pair of mutually spaced pivots;

first coupling means connecting said first arm and said gating means and adapted to transmit force therebetween;

second coupling means connecting said second arm and said locking means and adapted to transmit force therebetween;

said coupling means being effective to limit the motion of each of said arms to a pivot angle defined by predetermined start and final positions respectively, said pivot angles being selected such that, for a constant spacing between selected reference points on said arms during motion toward said final position, the mutual arm spacing increases between points positioned radially outward from said reference points and decreases for points positioned radially inward thereof;

coin receiving means adapted to interpose a coin at said start position as a force-transmitting linkage element between said arms;

a first spacer permanently disposed between said arms radially inward of said interposed coin, said first spacer having a length selected to relieve the force on said coin by imposing a first mutual spacing of said arms beyond a predetermined intermediate arm position;

interposer means normally disposed in a retracted position;

means responsive to the recognition of said identification indicia to provide an output signal; and means responsive to said output signal to move said interposer means to an operative position between said arms radially displaced from said first spacer;

said interposer means being adapted to impose a second mutual spacing of said arms and to transmit force therebetween prior to being relieved by said first spacer;

whereby the force transmitted to said second arm is effective to unlock said gate.

2. Apparatus in accordance with claim 1 wherein the length of said interposer means and its radial position with respect to said first spacer are selected such that the force-relieving action of said first spacer occurs substantially at said intermediate arm position for said coin and for said interposer.

3. Apparatus in accordance with claim 2 wherein said interposer means is adapted to move between said retracted and said operative positions in a plane substantially normal to said common plane.

4. Apparatus in accordance with claim 1 and further comprising a second spacer permanently positioned between said arms radially displaced from said first spacer;

said interposer means comprising a latch element normally disposed in said retracted position; and means responsive to said output signal to move said latch element to said operative position, at least a portion of said latch element being disposed between one of said arms and said second spacer when said latch element is in said operative position.

5. Apparatus in accordance with claim 4 wherein said first and second arms comprise a coin lever and a release lever respectively;

said first and second spacers comprising a coin release bolt and a latch release bolt respectively carried by said coin lever, each of said bolts extending at an angle from said coin lever substantially in said common plane;

said latch element being mounted on said release lever so as to move therewith and being adapted to pivot relative to said release lever about an axis substantially parallel to said common plane.

6. Apparatus in accordance with claim 5 wherein said means responsive to said output signal comprises a solenoid including a movable core coupled to said latch element, the motion of said solenoid core being adapted to pivot said latch element between said retracted and said operative positions; and means for normally biasing said latch element to said retracted position.

7. Apparatus in accordance with claim 6 wherein said solenoid core is movable between an extended and a withdrawn position, said biasing means normally urging said core to said extended position.

8. Apparatus in accordance with claim 5 wherein said bolts each terminate in a rounded end facing said release lever, said latch element including a rounded contact bumper adapted to be positioned in contacting alignment with said rounded end of said latch release bolt when said latch element is in said operative position;

said contact bumper being positioned adjacent a force-receiving backup surface of said release lever when said latch element is in said operative position.

9. Apparatus in accordance with claim 8 wherein said latch release bolt is positioned radially inward from said coin release bolt, the position of said latch release bolt end relative to said contact bumper being selected such that, when said latch element is in its operative position, said last-recited end and said contact bumper slide out of alignment with each other during lever movement beyond said intermediate position;

whereby said latch element is enabled to pivot to its retracted position upon termination of said output signal prior to the arrival of said levers at said final position.

10. Apparatus in accordance with claim 8 wherein said latch release bolt is positioned radially outward from said coin release bolt, the position of said latch release bolt end being selected such that, when said latch is in its operative position, said last-recited end separates from said contact bumper and moves out of alignment therewith during lever movement beyond said intermediate position;

whereby said latch element is enabled to pivot to its retracted position upon termination of said output signal prior to the arrival of said levers at said final position.

11. Apparatus in accordance with claim 5 wherein said bolts extend substantially at right angles to their respective levers; and means for individually adjusting the length of each of said bolts.

12. Apparatus in accordance with claim 11 and further including a bracket mounted on said coin lever;

a first bore in said bracket slidably engaged by said coin release bolt;

a set screw in said bracket adapted to fasten said bolt in said bore at a selected length relative to said coin lever;

a second bore in said bracket threadedly engaged by said latch release bolt; and a nut engaging the thread of said last-recited bolt to fasten the latter in position at a selected length relative to said coin lever.

13. Apparatus in accordance with claim 1 wherein said recognition indicia comprises an encoded card;

a card reader; and circuit means connected to said card reader to provide said output signal in response to a predetermined code read off said card.

14. Apparatus in accordance with claim 13 and further including means responsive to the motion of said unlocked gating means for terminating said output signal.

15. Apparatus in accordance with claim 14 wherein said gating means comprises a rotatable turnstile;

a ratchet plate coupled to rotate with said turnstile;

said locking means comprising a pawl adapted to engage recesses on the periphery of said ratchet plate;

a counter;

means including a shaft geared to said ratchet plate to increment the count of said counter by one upon rotation of said ratchet plate;

said means for terminating said output signal comprising cam means adjustably disposed on said shaft, and stationary switch means positioned to be actuated by said cam means during the rotation of said shaft, said actuation being variable in time in accordance with the adjustment of said cam means.

16. Apparatus in accordance with claim 1 wherein said gating means comprises a rotatable turnstile;

a ratchet plate coupled to rotate with said turnstile and including a plurality of peripheral recesses, a like plurality of roller studs mounted on said ratchet plate;

a pivotably mounted pawl normally engaging a confronting one of said recesses to lock said ratchet plate and said turnstile against rotation;

a compression shoe urged into contact with said roller studs, said compression shoe being configured such that it is temporarily displaced radially of said ratchet plate upon rotation of the latter;

said second coupling means comprising a mechanical linkage connecting said second arm to said pawl, said second coupling means being adapted to pivot said pawl out of engagement with its confronting recess when said second arm pivots through said intermediate position.

17. Apparatus in accordance with claim 16 wherein said ratchet plate has three peripheral recesses and three roller studs mounted thereon, said recesses and said roller studs respectively being spaced at 120° intervals around said ratchet plate.

18. In an access control system, a mechanism comprising:

first and second arms disposed to pivot substantially in a common plane about a pair of mutually spaced pivots;

first coupling means adapted to transmit an externally generated force to said first arm;

second coupling means adapted to transmit force between said second arm and a point external to said mechanism;

said coupling means being effective to limit the motion of each of said arms to a pivot angle defined by predetermined start and final positions respectively, said pivot angle being selected such that, for a constant spacing between selected reference points on said arms during arm motion toward said final position, the mutual arm spacing increases between points positioned radially outward from said reference points and decreases for points positioned radially inward thereof;

means for alternatively interposing first or second force-transmitting linkages between said arms adapted to move therewith, said first linkage comprising a coin slide and a coin selectively inserted therein in force-transmitting relationship;

said second linkage including a latch element adapted to pivot between a retracted position and an operative position, at least a portion of said latch element being interposed in force-transmitting relationship between said arms in said operative position; and a first spacer positioned between said arms radially inward from said first linkage, said first spacer having a length selected to relieve the force applied to said coin or to said latch element respectively during said arm motion toward said final position.

19. Apparatus in accordance with claim 18 wherein said second linkage is positioned radially inward from said first linkage and is radially spaced from said first spacer.

20. Apparatus in accordance with claim 19 wherein said second linkage is positioned radially inward from said first spacer.

21. Apparatus in accordance with claim 19 wherein said second linkage is positioned radially outward from said first spacer.

22. Apparatus in accordance with claim 19 wherein the respective lengths of said linkages relative to said first spacer are selected so that the force applied to said coin or to said latch element respectively is relieved at a predetermined angular position of said arms intermediate said start and final positions.

23. Apparatus in accordance with claim 22 wherein said second linkage includes a second spacer permanently mounted on a first one of said arms and extending toward the second one of said arms, said latch element being pivotally mounted on said second arm in a manner whereby it is interposed between a force-receiving surface of said second arm and said second spacer in said operative position.

24. Apparatus in accordance with claim 23 wherein said first spacer comprises a first bolt mounted on said first arm and extending therefrom substantially perpendicularly toward said second arm, said first bolt terminating in a rounded end facing said second arm;

said second spacer comprising a second bolt mounted on said first arm radially inward of said first bolt and extending toward said second arm substantially parallel to said first bolt, said second bolt terminating in a rounded end facing said second arm; and said latch element including a rounded contact bumper in substantial alignment in said operative position with the end of said second bolt when said arms are between said start position and said intermediate position, but moving out of said alignment as said arms pivot beyond said intermediate position.

25. Apparatus in accordance with claim 24 wherein said latch element is positioned to pivot in a plane substantially perpendicular to said common plane;

means for normally biasing said latch element to said retracted position; and a bracket carried by said first arm, said bolts being mounted on said bracket in a manner permitting their respective lengths to be selectively varied.

* * * * *